United States Patent [19]

Powell

[11] Patent Number: 4,817,762

[45] Date of Patent: Apr. 4, 1989

[54] DISPENSER HANDLE FOR ROLLS OF FLEXIBLE SHEET MATERIAL

[76] Inventor: William R. Powell, 2740 Plateau Dr., Riva, Md. 21140

[21] Appl. No.: 119,035

[22] Filed: Nov. 10, 1987

[51] Int. Cl.[4] ..... B65H 59/04; B65H 23/06; B23B 31/26; B23B 31/40

[52] U.S. Cl. ..... 188/67; 242/96; 242/99; 279/2 R

[58] Field of Search ..... 188/67; 242/96, 99, 242/72 R; 279/2 R; 269/48.1

[56] References Cited

U.S. PATENT DOCUMENTS

| | | | |
|---|---|---|---|
| 2,914,330 | 11/1959 | Wheeler | 279/2 |
| 3,118,626 | 1/1964 | Shanks | 242/46.41 X |
| 3,182,565 | 5/1965 | Millard | 188/67 X |
| 4,179,081 | 12/1979 | Parry | 242/ |
| 4,248,392 | 2/1981 | Parry | 242/ |
| 4,298,392 | 2/1981 | Parry | 242/99 X |

OTHER PUBLICATIONS

American Machinist Grinding Book, 1912, F. H. Colin and F. A. Stanley.

*Primary Examiner*—Andres Kashnikow
*Assistant Examiner*—Richard Potosnak
*Attorney, Agent, or Firm*—Scrivener and Clarke

[57] ABSTRACT

A dispenser handle for controlling the speed with which flexible sheet material is stripped from a roll. The handle includes a spindle carrying at one end locking means insertable into the overside opening of a hollow cylindrical core on which the sheet material is wound. The spindle is of reduced diameter and carries, with clearance, a collapsible sleeve which the operator may squeeze to brake the spindle and hence the roll and the rate which the material is stripped from the roll.

2 Claims, 2 Drawing Sheets

DISPENSER HANDLE FOR ROLLS OF FLEXIBLE SHEET MATERIAL

FIELD OF THE INVENTION

This invention relates to dispenser handles and more particularly to dispenser handles which may be inserted into the hollow cores of rolls of flexible sheet material for the purpose of controlling the speed with which the material may be stripped from the rolls.

BACKGROUND OF THE INVENTION

Highly stretchable transparent flexible films are wound in rolls on hollow, heavy, paste board cores having an internal diameter of three inches. It is known to brake the rolls as the material is stripped therefrom for wrapping palletized articles in order that the material will stretch, not only to tightly encapsulate the article but also to increase the useful linear footage of the material which can stretch about three times its original length without tearing.

Braking the stripping speed has involved problems. For example, as the material is stripped from the roll, the roll turns increasingly faster requiring constant adjustment of the braking force and the only practical way to do this is by the use of hand pressure on spindle ends which project beyond the ends of the rolls. Because the interior diameter of a core is too large for spindles of a size capable of being gripped by the hands, an attempt has been made to provide reduced diameter spindles by the use of a device which resembles to a certain extent an old fashioned potato masher. With this device, the head is jambed into the core, which requires considerable effort, and an integral handle extends axially outwardly of the core to be grasped by the bare hands of the operator who applies hand pressure to the spindle to control the speed and hence the degree of stretch of the film material as it is stripped from the roll. Even with gloves on, this is extemely hard on the hands.

Another solution has been to rewind the material, without stretching it, from the original three inch core onto a unitary, reduced diameter spindle whose ends extend on either side beyond the roll. The diameter of the spindle is selected to receive there-over a flexible enlongated, tapered cup-shaped handle elements which the operator grips in his hands and squeezes and/or moves axially inwardly as necessary to brake the spindle and hence the speed with which the material is stripped from the rolls. Obviously the rewinding step is tedious and expensive and the use of the handle grips is very fatiguing when it is considered that not only must they be squeezed but they must also at all times have an inward axial force exerted thereon.

SUMMARY OF THE PRESENT INVENTION

The broad object of the present invention is to provide an improved dispenser handle for rolls of flexible sheet material wound on hollow cylindrical cores which overcomes the problem of existing handles.

More particularly it is an object of the invention to provide a dispenser handle comprising a spindle carrying at one end a collapsable and expansible locking means which may be easily inserted in collapsed condition into the standard three inch core with a portion of the spindle extending axially clear of the core. The locking means is then expanded by manipulation of operating means carried by the spindle, into locking engagement with the interior surface of the core. A collapsible braking sleeve surrounds the clearance a part of the extending portion of the spindle and is of a size to be easily grasped by the operator and collapsed as necessary into braking engagement with the spindle to control the rotational speed of the roll and hence the stretch of the flexible material as it is stripped from the roll.

Figure 3:
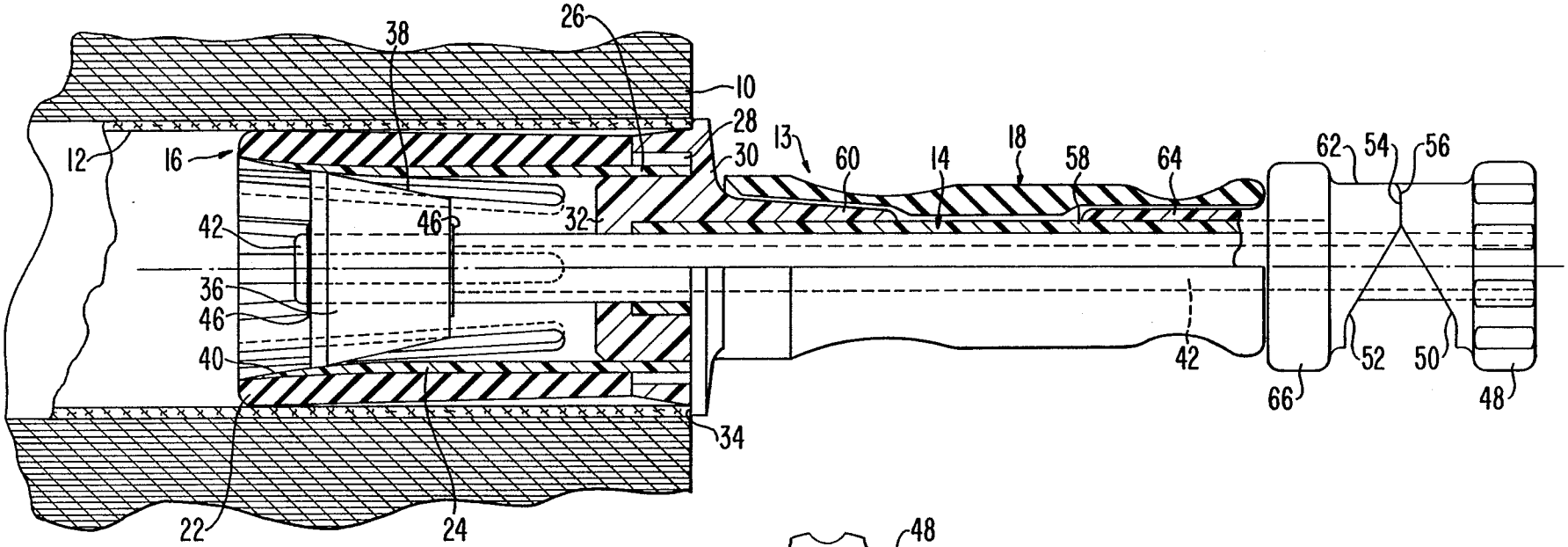
FIG. 3 is a partly broken, vertical cross-sectional view similar to FIG. 1 but showing the dispenser handle inserted into the core of a roll of flexible sheet material and in its locking condition.
Figure 4:
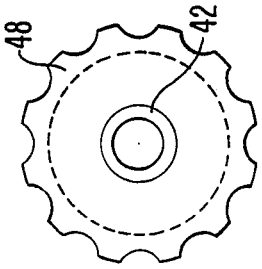
FIG. 4 is a vertical cross-sectional view of the right hand end of the handle of FIG. 3.

Referring now to the drawings there is illustrated in FIG. 3 a roll 10 of flexible sheet material such as stretchable transparent plastic film, wound on a hollow cylindrical core 12 of stiff paste board or similar material and having a standard internal diameter of three inches. The present invention is directed to a dispenser handle, broadly indicated by the numeral 13, which may be inserted into the opposite ends of the core 12.

Figure 1:
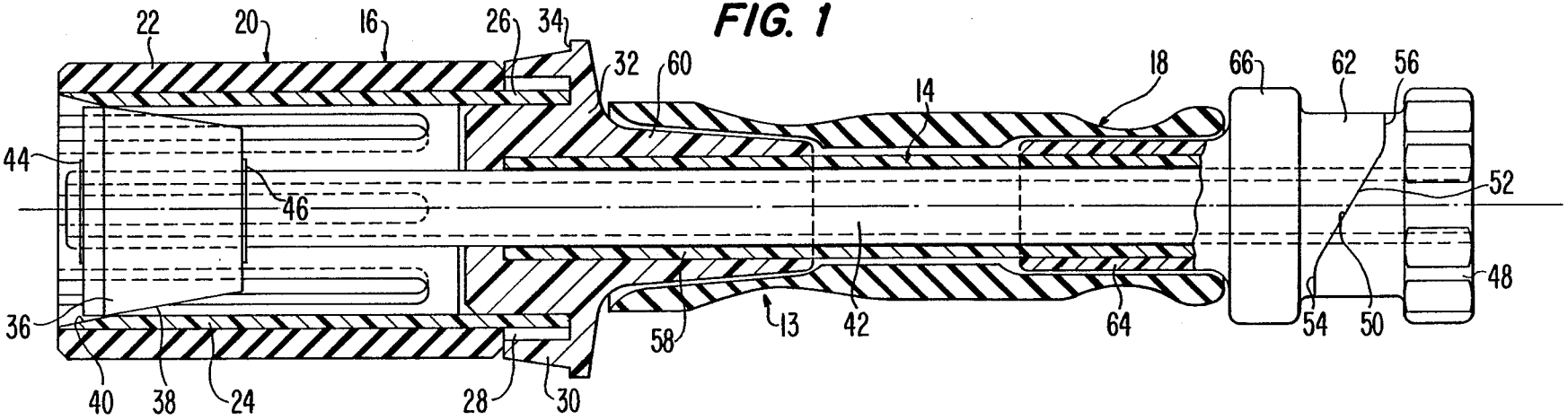
FIG. 1 is a vertical cross-sectional view of the dispenser handle of the invention shown in its non-locking condition.

Broadly, the handle of the invention, as best seen in FIG. 1, comprises a spindle, broadly indicated by the numeral 14 and later described in detail. Locking means, broadly indicated by the numeral 16, is fixed to the spindle 14 proximate one end thereof and is insertable into the exposed open end of the core 12, as shown in FIG. 3, for tight, substantially rigid locking engagement with the interior surface of the core, with at least a portion of the spindle 14 extending co-axially clear of the core. In accordance with the invention, a friction sleeve 18 surrounds with clearance at least a part of the extending portion of the spindle 14, the sleeve being of a size to be manually collapsible into frictional engagement with the spindle 14 to control the rotational speed thereof and hence that of a roll 10 when the locking means 16 is lockingly engaged with the interior surface of the core, as shown in FIG. 3, while the flexible sheet material is being stripped from the roll.

The locking means comprises a radially collapsible and expansible component 20 such as the flexible sleeve 22 or fingers 24, or a combination of both as shown, and includes means, a preferred one of which being hereinafter described in detail, for selectively operating the component 20 between its collapsed and expanded conditions, the component in its collapsed condition, as in FIG. 1, being of a size to permit its free insertion into the interior of the core 12 and thereafter, upon actuation of the operating means, to be expanded to a size for substantially rigid locking engagement with the interior surface of the core.

Though any collapsible and expandable component is included within the purview of the invention, a preferred component comprises the previously mentioned plurality of flexible fingers 24 shown, each having one end fixed to the spindle, as by way of an integral ring 26 received within a groove 28 in a flange 30 on a part 32 of the spindle. The forward outer surface of the flange 30 is slightly tapered and of a size to be slidably received within the open end of the core until an annular flange part 34 abuts the core end as seen in FIG. 3. Though the fingers 24, are shown cooperating with a flexible sleeve 22, and this is preferred, it is within the purview of the invention to utilize fingers only which extend freely in a direction substantially parallel to the axis of the spindle.

The means for expanding the fingers outwardly towards the interior surface of the core includes an expander element 36 movable between an inoperative position, as viewed in FIG. 1, wherein the fingers are enabled to collapse in the direction of the axis of the spidle, to an operative position as viewed in FIG. 3 to exert a radial force on the fingers to move them radially outwardly with respect to the axis of the spindle. Operating means are carried by the extending portion of the spindle to operate the expander element between its operative and inoperative positions. One specific type of expander element and means for operating it will herein after be described in detail.

Instead of fingers, the expansible and collapsible component could be the flexible sleeve 22 by itself in which a suitable expander element can operate to expand the sleeve from a collapsed condition to an expanded condition in tight, substantially rigid engagement with the inner surface of the core.

The expander element 36 shown is axially movable and includes a conical surface 38 which tapers in the direction of the fixed ends, that is to say, in the direction of the ring 26, of the fingers 24. The conical surface 38 is arranged to increasingly engage the free ends of the fingers to move them radially outwardly as the operating means, to be described, is actuated to move the expander element 36 axially from its inoperative position of FIG. 1 towards its operative position of FIG. 3.

Figure 2:
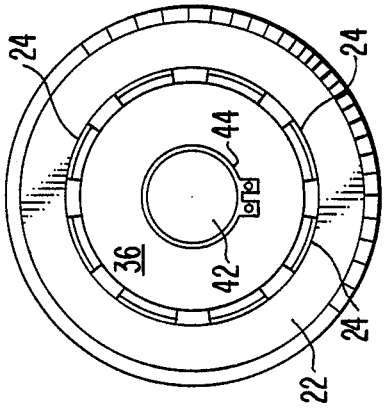
FIG. 2 is a vertical elevational view of the left end of the handle of FIG. 1.

Though the fingers could be expanded into direct engagement with the interior surface of the core, or the sleeve 22 by itself could be expanded, preferably the fingers are expanded against the flexible sleeve 22 as clearly shown in FIGS. 1 and 2. An advantage of this arrangement is that the outer ends of the fingers can also be tapered as shown at 40 to facilitate axial movement of the expander relative to the fingers. Without this additional taper there could be a tendency for the expander element to become jambed between the inner faces of the fingers or within the sleeve should the latter be used by itself.

Though the expander element could be moved in a variety of ways, one convenient way, in accordance with the invention, is by the provision of a shaft 42 to one end of which the expander element is connected by circlips 44, 46. The shaft 42 is slidably received within the spindle, and fixed to the opposite end of the shaft 42 is a knob 48. Cooperating ramp surfaces 50, 52 are provided on the knob and spindle, respectively, which, in one rotational position of the knob relative to the spindle, positions the expander element 36 in its inoperative position, as shown in FIG. 1, and in a second rotational position moves the expander element axially to its operative position of FIG. 3. Desirably the ramps 50, 52 terminate in flats 54, 56, respectively, such that when the knob 48 is in its second position of FIG. 3, the flats engage to releasaby retain the expander element in its operative position.

Though it is within the purview of the invention for the spindle to be molded as a single unit, it may be constructed in three parts integrally connected together, as shown, and comprising a tubular member 58 received in a counter bore in the flanged member 30 and which, in turn, is provided with a tail piece 60 tapering in the direction of the outer end of the spindle. The opposite end of the tubular member 58 extends through a member 62 which carries the ramp 52 and is provided with a forwardly extending tapering part 64 and a collar 66 which, with the flange 30, serves to loosely trap the brake sleeve 18 in its position of use. The inner surface of the sleeve 18 is shaped to conform to the profile of the spindle as determined by the parts 60, 64 of the members 30 and 62 and the intermediate portion of the tubular member 58.

Though the invention shows and describes an axially movable expander element, the invention is not limited to such an element. For example, the expander element could be similar to booted expandable stoppers wherein the knob would be rotated to expand the stopper boot into close engagement with the fingers and/or the sleeve 22. Thus any known locking means which is insertable into the exposed open end of a core for tight, substantially rigid locking engagement with the interior surface of the core is within the purview of the invention.

The use of the invention should be apparent from the foregoing description. To summarize, briefly, with the expander element in its inoperative position of FIG. 1, the locking sleeve is easily inserted with clearance into the open end of the core. The operator then twists the knob 48 to cause the knob ramp 52 to slide up the spindle ramp 50 until the flats 54, 56 engage at which point the expander element 36 has been moved to the position of FIG. 3 whereupon the fingers 24 are thrust radially outwardly against the sleeve 22 to expand it into tight locking engagement with the interior surface of the core. A handle is, of course, inserted into each end of the core. The operator then picks up the roll with his hands encircling the brake sleeves 18 and the end of the film is wrapped once around the object to be wrapped. Thereafter the object is rotated to strip film from the roll. As the film is stripped the operator applies whatever braking force is required to the braking sleeves 18 to ensure that the film is stretched to the desired degree without breaking, the operator constantly adjusting the braking force by his squeeze on the handles to compensate for changes occurring as the diameter of the roll decreases.

It will be apparent to those skilled in the art that the invention is susceptible of a variety of changes and modifications, without, however, departing from the scope and spirit of the appended claims.

What is claimed is:

1. A dispenser handle for a roll of flexible sheet material wound on a hollow cylindrical core comprising a spindle having a first part carrying an annular, radially expandable means for locking engagement with the interior wall of a hollow core and a second part adapted to extend co-axially clear of said core when said first part is engaged therewith, said second part carrying a pair of axially spaced flanges, a manually collapsible friction sleeve surrounding with clearance that portion of the spindle between said flanges whereby said sleeve is at all times trapped on said spindle against axial separation therefrom, a concical expander element axially movable within said annular expandable means to effect movement thereof between a collapsed condition enabling its free movement into and out of a core and an expanded locking condition, a first ramp carried by the outer end of the second part of said spindle, a shaft connected at one end to said expander element and passing co-axially and slideably through said spindle with its opposite and extending beyond said first ramp, a second ramp carried on the extending end of said shaft and slideably engaging said first ramp, a knob integrally connected to said second ramp and being rotatable to a first position causing said second ramp to slide up said first ramp and move said shaft and expander element axially to effect radial expansion of said expander element, said knob being rotatable to a second position enabling said shaft and said expander element to be moved in the opposite direction to permit collapse of said expandable element, and flats at the upper ends of the respective ramps arranged to interengage when said knob is rotated to its first position to retain said expander element in a position wherein said expandable means is retained in its expanded condition.

2. The dispenser handle of claim 1, wherein said expandle means comprises flexible fingers and a resilient sleeve surrounding said fingers.

* * * * *